United States Patent [19]

Asick et al.

[11] 4,380,361

[45] Apr. 19, 1983

[54] ELECTRICAL CONNECTOR COVER KIT

[75] Inventors: John C. Asick, Harrisburg; Donald A. Berry, Elizabethtown; John E. Lucius, Enola, all of Pa.

[73] Assignee: AMP Incorporated, Harrisburg, Pa.

[21] Appl. No.: 239,809

[22] Filed: Mar. 2, 1981

[51] Int. Cl.[3] ..... H01R 13/514

[52] U.S. Cl. ..... 339/91 R; 339/186 M; 339/206 R

[58] Field of Search ..... 339/97 P, 98, 99 R, 339/107, 206 R, 186 R, 186 M, 91 R

[56] References Cited

U.S. PATENT DOCUMENTS

| | | | |
|---|---|---|---|
| 3,363,224 | 1/1968 | Gluntz et al. | 339/258 |
| 3,569,900 | 3/1971 | Uberbacker | 339/107 |
| 4,037,906 | 7/1977 | Jayne | 339/107 |
| 4,053,197 | 10/1977 | Teagno | 339/99 R |
| 4,160,573 | 7/1979 | Weisenburger | 339/99 R |
| 4,243,288 | 1/1981 | Lucius et al. | 339/99 R |
| 4,269,466 | 5/1981 | Huber | 339/107 |

*Primary Examiner*—John McQuade
*Assistant Examiner*—Gary F. Paumen
*Attorney, Agent, or Firm*—Russell J. Egan

[57] ABSTRACT

A cover kit is disclosed for use in enclosing an open portion of a housing for a known electrical connector. The cover kit includes a first cover member one end of which engages one side of an elongated connector housing with the other end extending across the rear edge of the housing and a second mating cover member selected from a group of cover members each having distinguishing features. The second cover members each have a first end which engages the opposite side of the connector housing and a second end which engages the other end of the first cover member to securely enclose the connector housing. The second cover members provide keying, polarization, profile alteration, and latching for the connector.

5 Claims, 8 Drawing Figures

ELECTRICAL CONNECTOR COVER KIT

BACKGROUND OF THE INVENTION

1. The Field of the Invention

The present invention relates to a cover kit for enclosing an open rear portion of an electrical connector and in particular to a cover kit which can be used to alter the connector for various functional configurations.

2. The Prior Art

There is often a need to provide a variation in the profile of a standard electrical connector in order to assure proper mating with a further connector or a particular piece of apparatus. Such changes in profile are often necessary for effecting polarization and/or keying of the connector but can also serve a variety of other useful functions including latching. However, it is quite inconvenient to modify the profile of the known connector by providing a whole array of connector housings each with a different one of the various required profiles. Such an arrangement would unduely be burdensome in requiring a large amount of stock to be on hand and perhaps would even require different terminating techniques for the individual connectors. The present invention overcomes this problem by providing a kit of cover members which can selectively be assembled to alter the profile of an electrical connector as desired.

SUMMARY OF THE INVENTION

The present invention relates to a cover kit to be used in conjunction with an electrical connector in order to selectively vary the profile of the connector. The kit comprises a first cover member which has a first end adapted to engage the connector housing and a second opposite end adapted to enclose the rear of the connector housing and engage a second cover member. The second cover member is selected from a group of members having a variety of profiles designed for keying, polarizing, latching and other useful purposes. Each second cover has a first end which is received in engagement with the opposite side of the connector housing from the first cover and a second end which is detachably secured to the first cover member.

It is therefore an object of the present invention to produce a cover kit to be used in conjunction with a known electrical connector to provide a rapid and ready means for varying the profile of the connector as desired.

It is a further object of the present invention to produce a cover kit for an electrical connector which includes a first cover selectively attached to a first side of the connector housing and a second cover selected from a group of various profiles and detachably secured to the opposite sides of the connector housing and to the first cover.

It is yet another object of the present invention to produce a cover kit for electrical connectors which kit can be readily and economically manufactured.

The means for accomplishing the foregoing objects and other advantages of the present invention will become apparent to those skilled in the art from the following detailed description with reference to the accompanying drawings.

DETAILED DESCRIPTION OF THE PREFERRED EMBODIMENT

Figure 1:
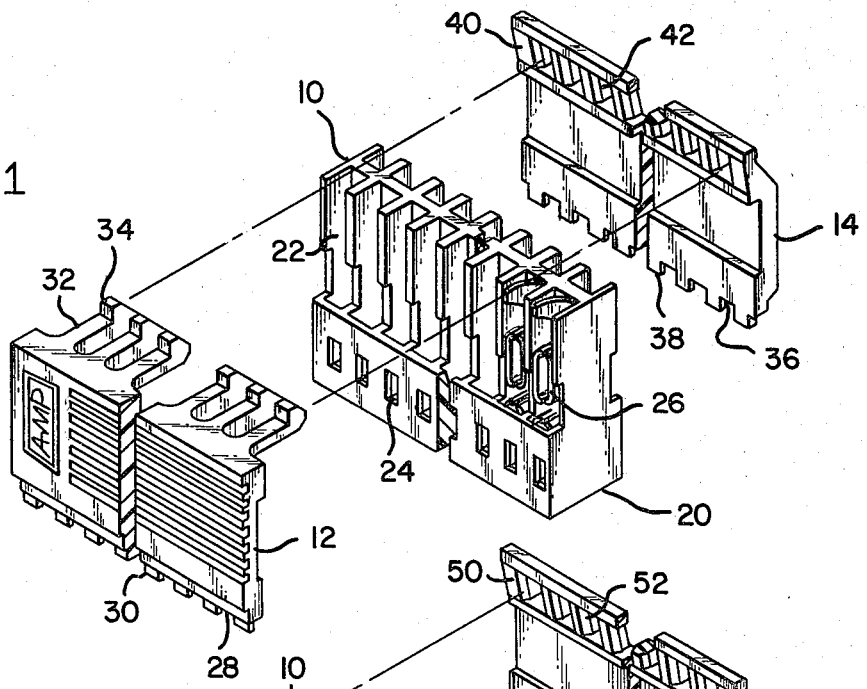
FIG. 1 is an exploded perspective view of a first embodiment of the present invention in which the second cover has a plain profile.

The present invention is used in combination with a known electrical connector having a housing 10. The housing 10 is fully described in U.S. Pat. No. 4,243,288, the disclosure of which is incorporated herein by reference. The housing is an elongated member of rigid plastics material having a mating face 20 with a plurality of terminal passages 22 opening therein in a pair of aligned rows. The sides of the housing are open at the rear so that the passages 22 are enclosed at their forward ends and are channel-shaped opening outwardly at their rearward ends. The housing is also provided with a plurality of apertures 24 each aligned with an opening into a respective passage at a point spaced rearwardly of the mating face 20. The connector includes a like plurality of terminals 26 each received in a respective passage of the housing. Each terminal includes a forward mating end (not shown) which is preferably a pin receptacle of the type disclosed in U.S. Pat. No. 3,363,224, the disclosure of which is incorporated herein by reference. The rear portion of this terminal is preferably of the insulation displacing type as disclosed in U.S. patent application 927,720 filed July 25, 1978, now abandoned the disclosure of which is incorporated herein by reference. The connector would be used to terminate a plurality of conductors (not shown) which can be either loose or in cable form.

A first cover 12 is identical for each embodiment of the subject cover kit. Each first cover 12 has a housing engaging edge portion 28, including a plurality of tines 30 each aligned to be received in a respective passage 22 of the housing. The cover further includes, at the rear end, a plurality of depending latching legs 32 each with a rearwardly directed shoulder 34 adjacent the free end thereof.

Figure 2:
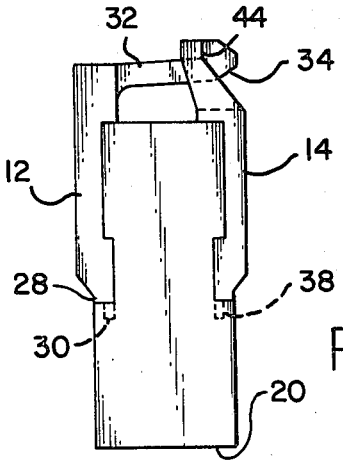
FIG. 2 is a side elevation of the connector assembly according to FIG. 1.

The first embodiment of a second cover 14 for the subject kit is shown in FIGS. 1 and 2 and is quite similar to the first cover 12. It has a first housing engaging edge 36 with a plurality of tines 38 extending therefrom, each aligned to be received in a respective passage 22 on the opposite side of the housing 10. The rear edge of the second cover 14 is formed as a lattice 40 with a plurality of apertures 42 spaced apart and aligned to receive respective legs 32 of the first cover therein and provide a shoulder 44 against which the shoulders 34 of legs 32 engage.

Figure 3:
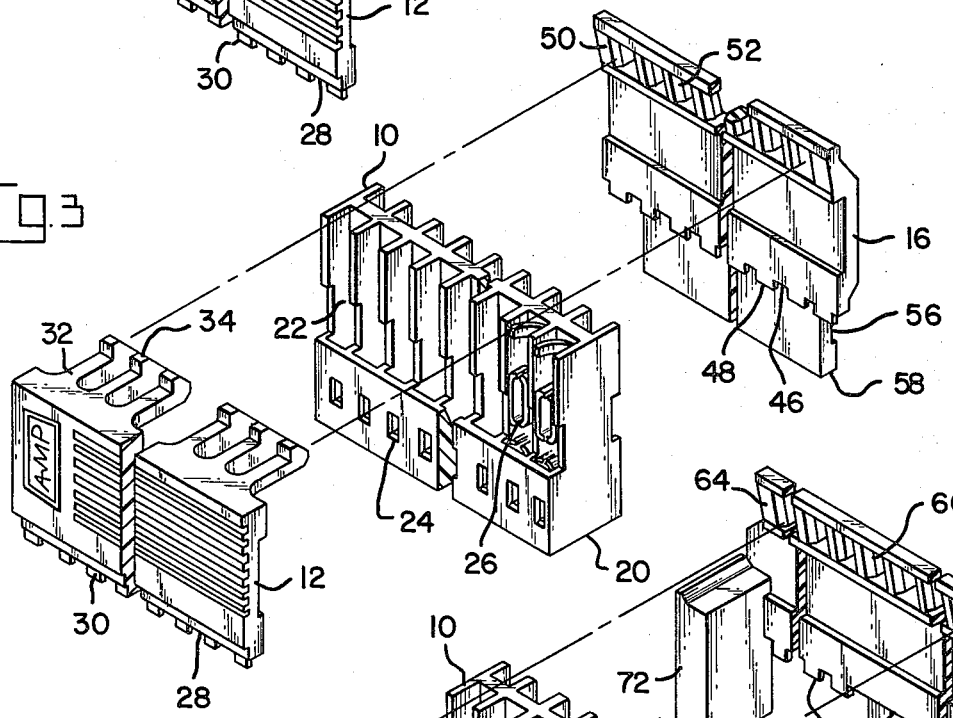
FIG. 3 is an exploded perspective view of a second embodiment of the subject invention in which the second cover has a polarized profile.
Figure 4:
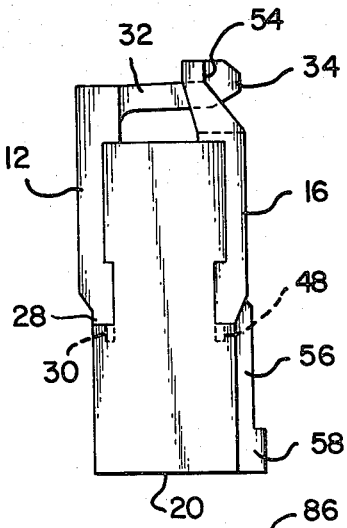
FIG. 4 is a side elevation of the connector assembly according to FIG. 3.

The second embodiment of the second cover 16 is shown in FIGS. 3 and 4 and has a like housing engaging edge portion 46 including a plurality of tines 48 extending therefrom. The rear edge of the second embodiment of the second cover 16 is also formed as a lattice 50 with a plurality of spaced apart apertures 52 and a shoulder 54. This embodiment of the second cover also includes a forwardly directed flange 56 extending parallel to the tines 48 and spaced from them a distance so as to be coplanar with and overlie a portion of the housing 10. The flange 56 has a profiled free edge 58 which is aligned with and forms an extension of the mating face 20 to alter and polarize the mating profile of the connector.

Figure 5:
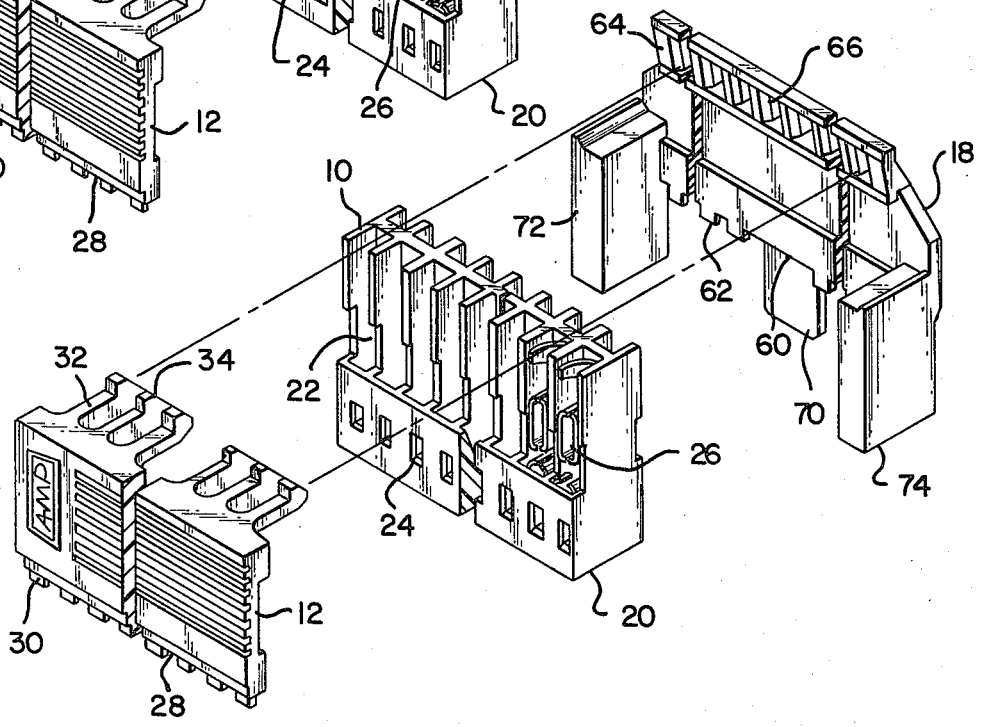
FIG. 5 is an exploded perspective view of a third embodiment of the subject invention in which the second cover has a polarization and lengthening profile.
Figure 6:
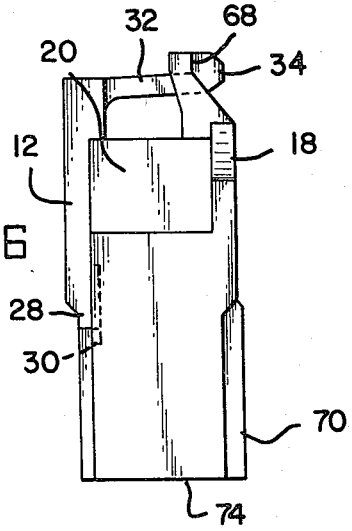
FIG. 6 is a side elevation of the connector assembly according to FIG. 5.

The third embodiment of the second cover is shown in FIGS. 5 and 6 and has a housing engaging edge portion 60 with a plurality of tines 62 extending therefrom to engage in a respective passage 22 of the housing 10. This second cover also includes a lattice 64 at the rear edge defining a plurality of apertures 66 and a shoulder 68. This embodiment further includes a keying tine 70 extending from the edge 60 in parallel spaced relationship to the tines 20 spaced a distance therefrom to overlie the housing 10. This keying tine 70 may be centered, as shown, and also be provided with a fracture line so that the keying tine can be removed if that is desired. This embodiment further includes a pair of parallel spaced side walls 72, 74 which extend normal to the plane of the second cover and enclose the opposite ends of the housing 10.

Figure 7:
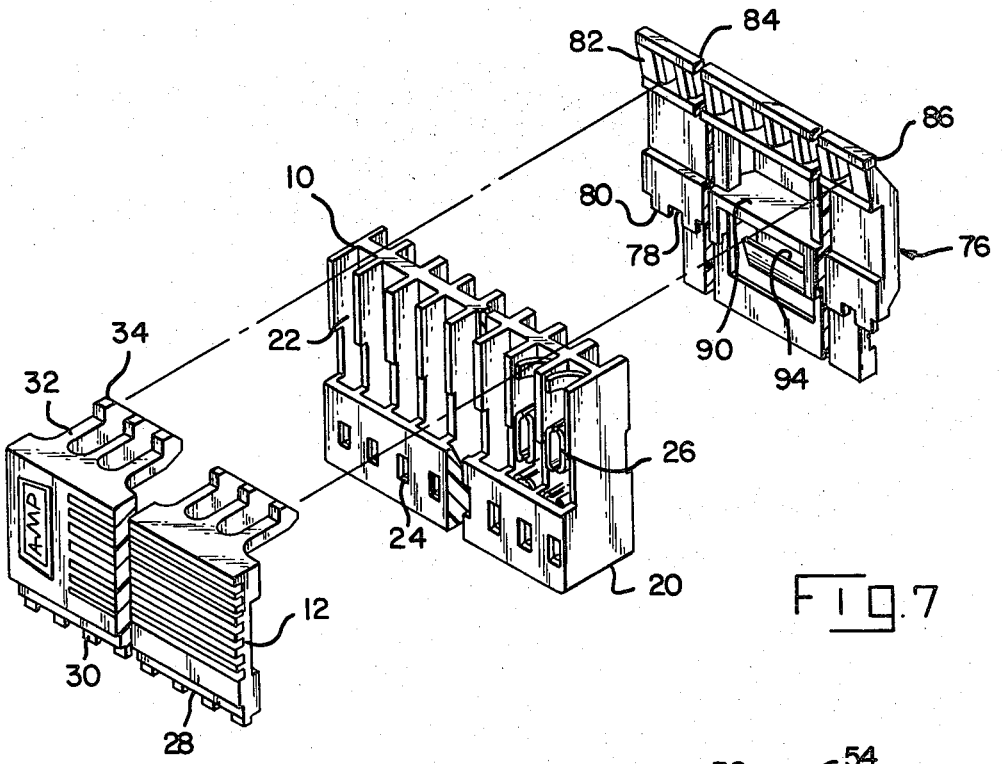
FIG. 7 is an exploded perspective view of a fourth embodiment of the subject invention in which the second cover has a latching feature.
Figure 8:
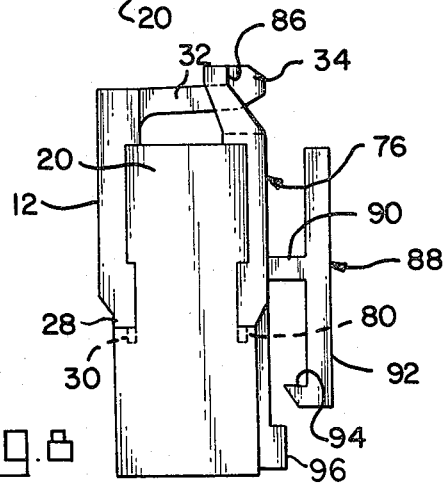
FIG. 8 is a side elevation of the connector assembly according to FIG. 7.

The fourth embodiment of the second cover 76 is shown in FIGS. 7 and 8 and has a first housing engaging edge 78 with a plurality of tines 80 extending therefrom to engage in respective passages 22 of the housing 10, and a profiling or keying edge 96 (in the manner of edge 58). The rear edge of this second cover also has a lattice 82 forming a plurality of apertures 84 and shoulder 86. This embodiment further has a latch 88 including a pivot 90, extending normal from the plane of the cover, and a beam 92 with a latching lug engaging shoulder 94 on one end thereof.

All embodiments of the present invention are assembled in the same fashion. The first cover 12 is engaged with housing 10 by inserting the tines 30 into the respective passages 22 and pivoting the cover so that the legs 32 extend through the conductors (not shown) and across the rear of the housing 10. The appropriate second cover is selected and then similarly engaged with the housing by inserting the tines into the passages in the opposite side of the housing and rotating the cover until the legs 32 extend through the apertures in the lattice and the respective shoulders engage. The covers will thus be securely positioned on the connector and will profile the connector as desired.

The present invention may be subject to many modifications and changes without departing from the spirit or essential characteristics thereof. The present embodiments are therefore to be considered in all respects as illustrative and not restrictive of the scope of the invention.

What is claimed is:

1. A cover kit for an electrical connector said kit comprising:

a first cover and a plurality of second covers each having a profile different from the others of said second covers, said first cover having a forward edge with means to engage a first side of a housing of an electrical connector and a plurality of parallel spaced latching legs at an opposite rear edge enclosing and extending across a rear portion of said housing, said second cover having a forward edge with means to engage the opposite side of said housing and an opposite rear edge profiled to define a plurality of apertures for intermating engagement with said latching legs of first cover to be detachably latched thereto enclosing said housing.

2. The cover kit according to claim 1 wherein said second cover further comprises keying means extending forwardly of said forward edge to lie substantially coplanar with the mating face of said housing.

3. The cover kit according to claim 1 wherein said second cover further comprises a pair of parallel spaced side walls depending from opposite ends of said second cover to enclose opposite ends of said housing.

4. The cover kit according to claim 1 wherein said second cover further comprises a portion extending forwardly of said forward edge to lie along said housing to alter the profile thereof.

5. The cover kit according to claim 1 wherein said second cover further comprises latching means integral therewith and adapted to make latching engagement with a further electrical connector.

* * * * *